US009409313B2

(12) United States Patent
Shimizu

(10) Patent No.: US 9,409,313 B2
(45) Date of Patent: Aug. 9, 2016

(54) CONCRETE MIXER TRUCK

(75) Inventor: Hiroyuki Shimizu, Saitama (JP)

(73) Assignee: KYB Corporation, Tokyo (JP)

( * ) Notice: Subject to any disclaimer, the term of this patent is extended or adjusted under 35 U.S.C. 154(b) by 663 days.

(21) Appl. No.: 13/546,114

(22) Filed: Jul. 11, 2012

(65) Prior Publication Data

US 2013/0021867 A1 Jan. 24, 2013

(30) Foreign Application Priority Data

Jul. 19, 2011 (AU) ..... 2011204860

(51) Int. Cl.
*B28C 5/42* (2006.01)
*B28C 7/02* (2006.01)
*B28C 7/12* (2006.01)

(52) U.S. Cl.
CPC ..... *B28C 5/422* (2013.01); *B28C 7/026* (2013.01); *B28C 7/12* (2013.01)

(58) Field of Classification Search
CPC ..... B28C 5/422
USPC ..... 366/40, 44, 61; 700/265
See application file for complete search history.

(56) References Cited

U.S. PATENT DOCUMENTS 2,703,227 A * 3/1955 Hughes ..... B28C 5/4241 177/116
4,097,925 A * 6/1978 Butler, Jr. ..... B28C 5/4213 366/2
4,544,275 A * 10/1985 Hudelmaier ..... 366/30
7,489,993 B2 * 2/2009 Coffee et al. ..... 701/32.3
7,866,875 B2 * 1/2011 Abe et al. ..... 366/61
8,727,604 B2 * 5/2014 Compton et al. ..... 366/61
2002/0015354 A1 * 2/2002 Buckelew ..... 366/2
2007/0185636 A1 * 8/2007 Cooley et al. ..... 701/50
2008/0316856 A1 * 12/2008 Cooley et al. ..... 366/142
2014/0198599 A1 * 7/2014 Kamijo ..... 366/61

FOREIGN PATENT DOCUMENTS

GB 1480395 A 7/1977
JP 2005022640 A 1/2005
WO 2005080058 A1 9/2005

OTHER PUBLICATIONS

Extended European Search Report issued Apr. 11, 2014, corresponds to European patent application No. 12176244.7.

* cited by examiner

*Primary Examiner* — David Sorkin
(74) *Attorney, Agent, or Firm* — Hauptman Ham, LLP

(57) ABSTRACT

A concrete mixer truck includes: a driving device that drives a mixer drum to rotate; a pressure sensor that detects a pressure of the working fluid in the driving device; a material introduction determination unit that determines whether or not a material for generating the mixed concrete has been introduced into the mixer drum; a pressure determination unit that determines whether or not the pressure of the working fluid detected by the pressure sensor has fallen to a set pressure set in advance in accordance with a carrying amount and a fluidity of the mixed concrete after the introduction of the materials for the mixed concrete into the mixer drum; and a notification device that notifies an operator that the pressure of the working fluid in the driving device has fallen to the set pressure on the basis of the determination made by the pressure determination unit.

10 Claims, 3 Drawing Sheets

CONCRETE MIXER TRUCK

FIELD OF THE INVENTION

This invention relates to a concrete mixer truck.

BACKGROUND OF THE INVENTION

A concrete mixer truck having a mixer drum capable of carrying freshly mixed concrete is used conventionally. The freshly mixed concrete is generated by introducing cement, aggregate, water, and so on into the mixer drum of the concrete mixer truck and driving the mixer drum to rotate so that the materials are mixed.

JP2005-022640A proposes a concrete mixer truck that includes an inspection instrument for performing a quality inspection when transported freshly mixed concrete is unloaded. In this concrete mixer truck, a slump test for measuring a fluidity of the freshly mixed concrete is performed on the freshly mixed concrete as the quality inspection. In a slump test, a slump, which is a numerical value indicating the fluidity of freshly mixed concrete, is measured. The fluidity of the freshly mixed concrete increases as the measured slump increases.

SUMMARY OF THE INVENTION

In a conventional concrete mixer truck, however, the slump of the freshly mixed concrete is adjusted by an operator using a rule of thumb, and therefore variation occurs in the slump of the freshly mixed concrete at the time of unloading, making it difficult to manage the quality of the freshly mixed concrete.

An object of this invention is to provide a concrete mixer truck that can manage the quality of freshly mixed concrete.

To achieve the above object, this invention provides a concrete mixer truck having a mixer drum capable of carrying freshly mixed concrete. The concrete mixer truck comprises a driving device that is driven by rotation of an engine so as to drive the mixer drum to rotate using a fluid pressure of a working fluid, a pressure detector that detects a pressure of the working fluid in the driving device, a controller having a material introduction determination unit that determines whether or not a material for generating the freshly mixed concrete has been introduced into the mixer drum, and a pressure determination unit that determines whether or not the pressure of the working fluid detected by the pressure detector has fallen to a set pressure set in advance in accordance with a carrying amount and a fluidity of the freshly mixed concrete after the introduction of the materials for the freshly mixed concrete into the mixer drum, and a notification device that notifies an operator that the pressure of the working fluid in the driving device has fallen to the set pressure on the basis of the determination made by the pressure determination unit.

The details as well as other features and advantages of this invention are set forth in the remainder of the specification and are shown in the accompanying drawings.

DESCRIPTION OF THE PREFERRED EMBODIMENTS

A concrete mixer truck 100 according to an embodiment of this invention will be described below with reference to the figures.

First, referring to FIGS. 1 and 2, the overall constitution of the concrete mixer truck 100 will be described.

Figure 1:
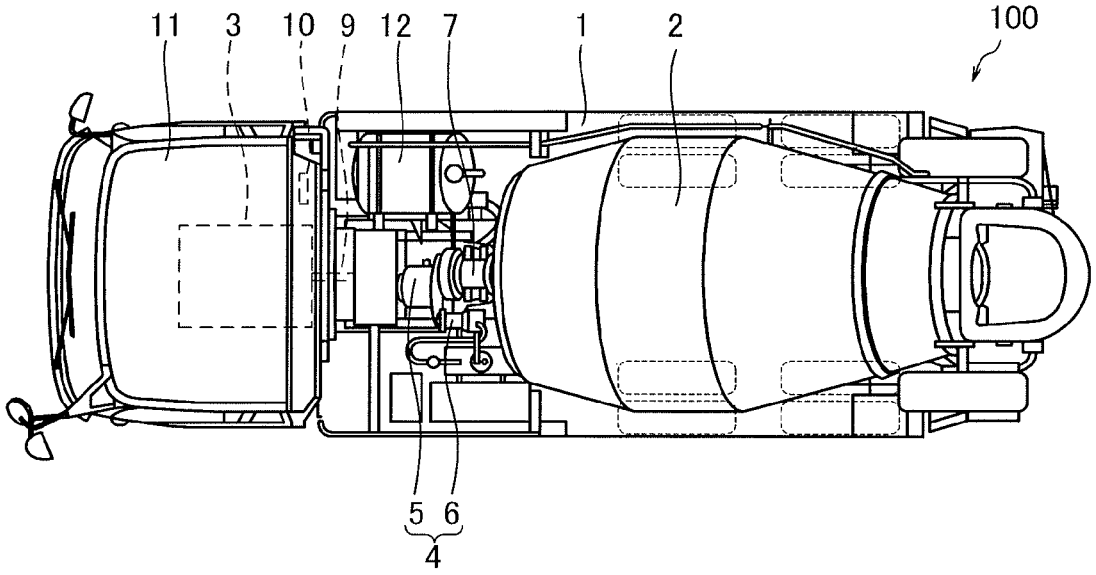
FIG. 1 is a plan view of a concrete mixer truck according to an embodiment of this invention.

As shown in FIG. 1, the concrete mixer truck 100 is a vehicle including an operating cab 11 and a frame 1. The concrete mixer truck 100 includes a mixer drum 2 carried on the frame 1 to be capable of carrying freshly mixed concrete, a driving device 4 that drives the mixer drum 2 to rotate, and a controller 10 that controls rotation of the mixer drum 2. The concrete mixer truck 100 transports freshly mixed concrete carried in the mixer drum 2.

The freshly mixed concrete can be generated by introducing materials such as cement, aggregate, and water into the mixer drum 2 of the concrete mixer truck 100 and driving the mixer drum 2 to rotate so that the materials are mixed.

The mixer drum 2 is a closed-end cylindrical container that is carried rotatably on the frame 1. The mixer drum 2 is carried such that a rotary axis thereof is oriented in a front-rear direction of the vehicle. The mixer drum 2 is tilted in the front-rear direction when carried so as to gradually increase in height toward a rear portion of the vehicle.

An opening portion is formed in a rear end of the mixer drum 2, and the freshly mixed concrete can be introduced and discharged through the opening portion. The mixer drum 2 is driven to rotate using a traveling engine 3 installed in the concrete mixer truck 100 as a power source.

The driving device 4 is driven by rotation of the engine 3 so as to drive the mixer drum 2 to rotate using a fluid pressure of a working fluid. A rotary motion of a crankshaft in the engine 3 is transmitted to the driving device 4 by a power take-off (PTO) mechanism 9 that continuously draws power from the engine 3, and a drive shaft 8 (see FIG. 2) that couples the power take-off mechanism 9 to the driving device 4.

Figure 2:
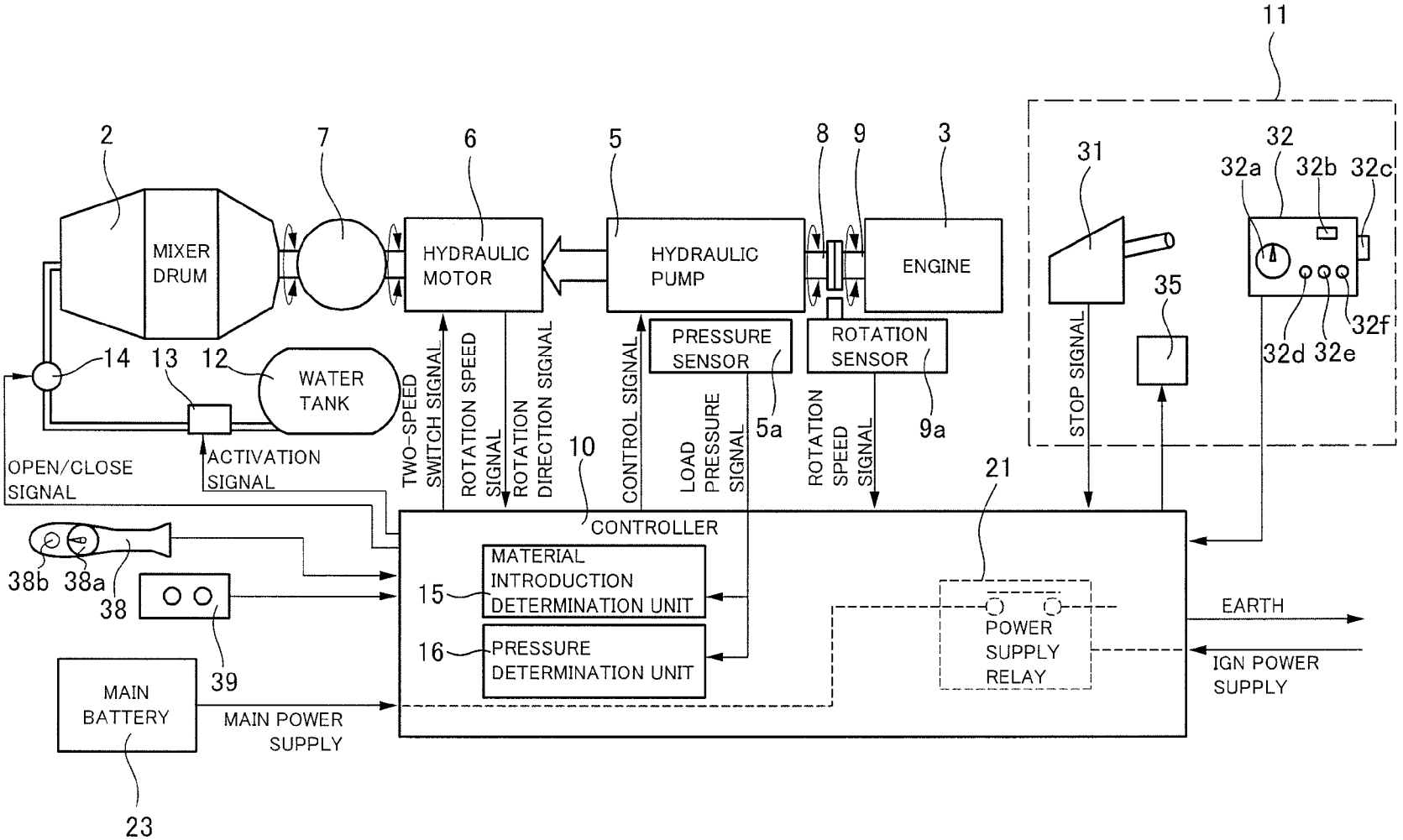
FIG. 2 is a block diagram showing control of the concrete mixer truck according to this embodiment of the invention.

As shown in FIG. 2, the power take-off mechanism 9 is provided with a rotation sensor 9*a* that detects a rotation speed and transmits a rotation speed signal corresponding to the detected rotation speed to the controller 10. A rotation speed of the drive shaft 8 may also be detected using the rotation sensor 9*a*.

In the driving device 4, working oil is used as the working fluid. An incompressible fluid other than working oil may be used as the working fluid. As shown in FIG. 1, the driving device 4 includes a hydraulic pump 5 that is driven by the engine 3 to serve as a fluid pressure pump for discharging the operating fluid, and a hydraulic motor 6 that is driven by the hydraulic pump 5 to serve as a fluid pressure motor for driving the mixer drum 2 to rotate. The driving device 4 is capable of rotating the mixer drum 2 forward and in reverse, and increasing and decreasing a rotation speed of the mixer drum 2.

The hydraulic pump 5 is driven to rotate by power drawn continuously from the engine 3 via the power take-off mechanism 9. Accordingly, a rotation speed of the hydraulic pump 5 is greatly affected by variation in the rotation speed of the engine 3 corresponding to a traveling condition of the vehicle. Hence, in the concrete mixer truck 100, operations of the hydraulic pump 5 and the hydraulic motor 6 are controlled by the controller 10 so that the mixer drum 2 reaches target rotation conditions in accordance with the rotation speed of the engine 3.

The hydraulic pump 5 is a swash plate type axial piston pump having a variable capacity. Upon reception of a command signal from the controller 10, the hydraulic pump 5 switches a tilt angle of the pump to a positive rotation direction or a reverse rotation direction. The hydraulic pump 5 includes a solenoid valve for adjusting the tilt angle. By switching the solenoid valve, a discharge direction and a discharge capacity of the hydraulic pump 5 are adjusted.

The working oil discharged from the hydraulic pump 5 is supplied to the hydraulic motor 6, whereby the hydraulic motor 6 rotates. The mixer drum 2 is coupled to the hydraulic motor 6 via a reduction gear 7. The mixer drum 2 thus rotates in accordance with the rotation of the hydraulic motor 6.

When the mixer drum 2 is operated to rotate forward by the hydraulic pump 5, the freshly mixed concrete in the mixer drum 2 is agitated. When the mixer drum 2 is operated to rotate in reverse by the hydraulic pump 5, on the other hand, the freshly mixed concrete in the mixer drum 2 is discharged to the outside through the opening portion in the rear end.

An oil pressure of the working oil discharged from the hydraulic pump 5 varies according to a carrying amount and a slump of freshly mixed concrete carried in the mixer drum 2. The hydraulic pump 5 is provided with a pressure sensor 5*a* (see FIG. 2) that serves as a pressure detector for detecting the pressure of the discharged working oil.

The slump is a numerical value indicating a fluidity of the freshly mixed concrete. The fluidity of the freshly mixed concrete increases as the numerical value of the slump increases. In other words, as the numerical value of the slump increases, the freshly mixed concrete becomes softer, and as the numerical value of the slump decreases, the freshly mixed concrete becomes harder. The freshly mixed concrete is mixed by driving the mixer drum 2 to rotate, and as a result, the slump of the freshly mixed concrete is adjusted so that an appropriate slump is realized at the time of unloading.

As shown in FIG. 2, the pressure sensor 5*a* transmits a load pressure signal to the controller 10 in accordance with the detected pressure of the working oil. The pressure sensor 5*a* may be provided in the hydraulic motor 6 rather than the hydraulic pump 5 in order to detect the pressure of the working oil in the hydraulic motor 6. In other words, the pressure sensor 5*a* is used to detect the pressure of the working oil in the driving device 4.

The hydraulic motor 6 is a swash plate type axial piston motor having a variable capacity. The hydraulic motor 6 is driven to rotate upon reception of a supply of the working oil discharged from the hydraulic pump 5. The hydraulic motor 6 includes a solenoid valve that adjusts a tilt angle of the motor upon reception of a command signal from the controller 10. By switching the solenoid valve, the capacity of the hydraulic motor 6 is switched between two stages, namely a small capacity for high-speed rotation and a large capacity for normal rotation.

The controller 10 controls the driving device 4. The controller 10 is a microcomputer including a CPU (Central Processing Unit), a ROM (Read-Only Memory), a RAM (Random Access Memory), and an I/O interface (input/output interface). The RAM stores data used in processing performed by the CPU. A control program of the CPU and so on are stored in the ROM in advance. The I/O interface is used to input and output information to and from a connected device. Control of the driving device 4 is realized by operating the CPU, the RAM, and so on in accordance with the program stored in the ROM.

As shown in FIG. 2, when an operator starts the engine 3 by operating an ignition switch in the operating cab 11, an ignition power supply is input into the controller 10. As a result, a power supply relay 21 is switched such that a main power supply from a main battery 23 is supplied to the controller 10, thereby activating the controller 10.

The concrete mixer truck 100 also includes a water tank 12 storing water, a water pressure pump 13 that aspirates and discharges the water in the water tank 12, and an open/close valve 14 provided between the water pressure pump 13 and the mixer drum 2.

The water pressure pump 13 and the open/close valve 14 are provided in a supply passage for supplying water into the mixer drum 2 from the water tank 12. The water pressure pump 13 is activated by an activation signal from the controller 10. The open/close valve 14 is opened and closed in accordance with an open/close signal from the controller 10.

The water in the water tank 12 is supplied into the mixer drum 2 when the water pressure pump 13 is activated and the open/close valve 14 is switched to an open state. The water in the water tank 12 can be replenished from an external water line at a plant or the like.

Next, referring to FIG. 2, control of the concrete mixer truck 100 will be described.

The controller 10 controls the operations of the hydraulic pump 5 and the hydraulic motor 6 such that the rotation direction and rotation speed of the mixer drum 2 reach target rotation conditions in accordance with a calculated rotation speed of the engine 3. More specifically, the controller 10 calculates a discharge direction and a discharge capacity of the hydraulic pump 5 such that the rotation direction and rotation speed of the mixer drum 2 reach the target rotation conditions. Further, the controller 10 calculates the capacity of the hydraulic motor 6, and outputs a control signal to the hydraulic pump 5 and a two-speed switch signal to the hydraulic motor 6.

A load pressure signal is input into the controller 10 from the hydraulic pump 5 via the pressure sensor 5*a*, and a rotation direction signal and a rotation speed signal are input into the controller 10 from the hydraulic motor 6 via sensors. The controller 10 controls the operations of the hydraulic pump 5 and the hydraulic motor 6 on the basis of these input signals.

The controller 10 includes a material introduction determination unit 15 that determines whether or not the materials for generating the freshly mixed concrete have been introduced into the mixer drum 2, and a pressure determination unit 16 that determines whether or not the working oil pressure detected by the pressure sensor 5*a* has fallen to a preset set pressure.

The material introduction determination unit 15 determines whether or not the materials for generating the freshly mixed concrete have been introduced into the mixer drum 2 on the basis of the load pressure signal from the pressure sensor 5*a*. When the materials are introduced into the mixer drum 2, greater force is required to rotate the mixer drum 2 than before the materials are introduced. Therefore, the discharge pressure of the hydraulic pump 5 increases.

The material introduction determination unit 15 determines that the materials have been introduced by detecting an increase in the discharge pressure. More specifically, the material introduction determination unit 15 determines that the materials have been introduced when an increase width of the discharge pressure of the hydraulic pump 5 exceeds a preset predetermined increase width.

In a steady state, the mixer drum 2 is driven by the driving device 4 to perform agitation rotation, which is rotation at a rotation speed at which a quality of the freshly mixed concrete in the mixer drum 2 can be maintained. When the material introduction determination unit 15 determines that the materials have been introduced into the mixer drum 2, the mixer drum 2 switches to mixing rotation, which is rotation at a higher speed than the agitation rotation. Thus, the materials in the mixer drum 2 can be mixed to generate the freshly mixed concrete.

The pressure determination unit 16 determines whether or not the freshly mixed concrete in the mixer drum 2 has reached an appropriate slump on the basis of the load pressure signal from the pressure sensor 5*a*. After a set time has elapsed following introduction of the materials for the freshly mixed concrete into the mixer drum 2, the pressure determination unit 16 determines on the basis of the signal from the pressure sensor 5*a* whether or not the discharge pressure of the hydraulic pump 5 has fallen to the set pressure.

When the freshly mixed concrete in the mixer drum 2 is mixed, the freshly mixed concrete gradually becomes softer, and therefore the force required to rotate the mixer drum 2 gradually decreases. Accordingly, the discharge pressure of the hydraulic pump 5 gradually falls. When the discharge pressure of the hydraulic pump 5 falls below the preset set pressure, the pressure determination unit 16 determines that the freshly mixed concrete has reached the appropriate slump.

The set pressure is set in advance in accordance with the amount of freshly mixed concrete carried in the mixer drum 2 as a working oil pressure at which the freshly mixed concrete in the mixer drum 2 reaches the appropriate slump.

To set the set pressure, first, an overall weight of the mixer drum 2, including the freshly mixed concrete carried therein, is measured using a weight sensor. The amount of carried freshly mixed concrete is then calculated by subtracting the weight of the mixer drum 2 from the measured weight.

Next, the mixer drum 2 is caused to perform the high-speed mixing rotation so that the freshly mixed concrete is mixed, whereupon the mixer drum 2 is switched to low-speed measurement rotation. The measurement rotation is rotation at a rotation speed for suppressing variation in the working oil pressure accompanying rotation of the mixer drum 2.

Next, a part of the freshly mixed concrete is removed from the mixer drum 2 and subjected to a slump test to measure the slump of the freshly mixed concrete. When the measured slump takes an appropriate numerical value, the discharge pressure of the hydraulic pump 5 is measured while the mixer drum 2 rotates in accordance with the measurement rotation. The discharge pressure of the hydraulic pump 5 at this time serves as the set pressure corresponding to the amount of freshly mixed concrete carried in the mixer drum 2.

It should be noted that the set pressure may be calculated in advance by the operator on the basis of the carrying amount and the slump of the freshly mixed concrete and input through an input unit provided on an operating device 32.

A parking brake 31, the operating device 32 for operating the mixer drum 2, and a notification device 35 for issuing notifications to the operator are disposed in the operating cab 11.

A detector that detects a lever position of the parking brake 31 is provided on the parking brake 31. When the parking brake 31 is applied, a stop signal is output to the controller 10 from a detector.

A knob type operating switch 32*a* for switching the rotation direction and rotation speed of the mixer drum 2, a stop switch 32*b* for halting rotation of the mixer drum 2 in an emergency, and an automatic agitation switch 32*c* for causing the mixer drum 2 to perform the agitation rotation automatically are provided on the operating device 32. Further, an introduction mode switch 32*d* for switching an introduction mode in which the materials of the freshly mixed concrete can be introduced into the mixer drum 2, a slump readjustment switch 32*e* for readjusting the slump of the freshly mixed concrete in the mixer drum 2, and a mixing switch 32*f* for mixing the freshly mixed concrete in the mixer drum 2 for a predetermined time are provided on the operating device 32.

When the operator operates the respective switches 32*a* to 32*f*, command signals are output to the controller 10 from the operating device 32. On the basis of the command signals, the controller 10 determines the target rotation conditions of the mixer drum 2, or more specifically the rotation direction and rotation speed.

A rotation operation of the mixer drum 2 will now be described. When the automatic agitation switch 32*c* is ON, the stop signal is not output from the parking brake 31, and when a vehicle speed is equal to or higher than a predetermined speed, the controller 10 determines that the vehicle is traveling. Accordingly, the controller 10 causes the mixer drum 2 to perform the agitation rotation automatically, thereby preventing discharge of the freshly mixed concrete and maintaining the quality of the freshly mixed concrete.

When the automatic agitation switch 32*c* is OFF, on the other hand, the controller 10 may operate the operating device 32 to rotate the mixer drum 2 in reverse so that the freshly mixed concrete in the mixer drum 2 can be discharged to the outside even though the vehicle is traveling. The controller 10 may likewise operate the operating device 32 to rotate the mixer drum 2 in reverse so that the freshly mixed concrete in the mixer drum 2 can be discharged to the outside when the stop signal is output from the parking brake 31.

On the basis of the determination made by the pressure determination unit 16, the notification device 35 notifies the operator that the working oil pressure has fallen to the set pressure. The notification device 35 is a buzzer that notifies the operator by sound, a lamp that provides the operator with visible notification, or similar.

A rear portion operating device 38 with which the mixer drum 2 can be operated from the exterior of the concrete mixer truck 100 is disposed on a rear portion of the concrete mixer truck 100. Similarly to the operating device 32, the rear portion operating device 38 is provided with a knob type operating switch 38*a* for switching the rotation direction and rotation speed of the mixer drum 2, and a stop switch 38*b* for halting rotation of the mixer drum 2 in an emergency. When the operator operates the rear portion operating device 38, command signals are output to the controller 10 from the rear portion operating device 38.

Further, an automatic washing/mixing operating device 39 that enables automatic washing of the interior of the mixer drum 2 and mixing of the freshly mixed concrete from the exterior of the concrete mixer truck 100 is disposed on the concrete mixer truck 100.

Figure 3:
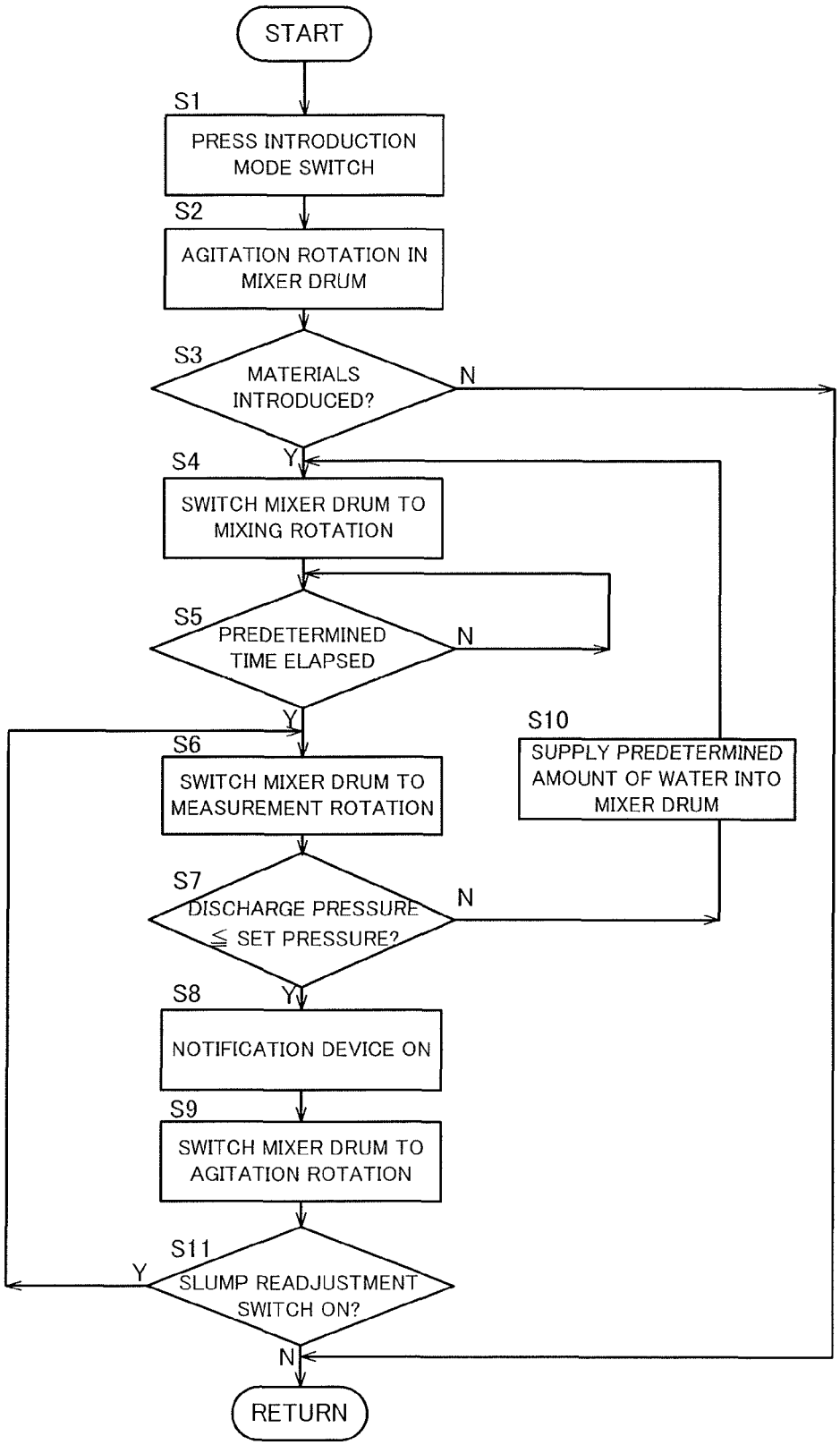
FIG. 3 is a flowchart showing a routine for adjusting a slump of freshly mixed concrete, which is performed in the concrete mixer truck according to this embodiment of this invention.

Next, referring to FIG. 3, a routine for adjusting the slump of the freshly mixed concrete, which is executed on the concrete mixer truck 100 by the controller 10, will be described. The controller 10 executes this routine repeatedly at fixed time intervals of 10 milliseconds, for example, while the engine 3 is operative.

The operator drives the concrete mixer truck 100 in advance to a material introduction position on a plant, and then stops the vehicle. When the concrete mixer truck 100 is stationary in the material introduction position and preparation for material introduction is complete, the operator operates the introduction mode switch 32*d*.

In a step 1, the introduction mode switch 32*d* is operated by the operator. When the introduction mode switch 32*d* is operated, the controller 10 switches to a material introduction mode and then advances to a step 2.

In the step 2, agitation rotation is begun in the mixer drum 2.

In a step 3, a determination is made as to whether or not the materials for the freshly mixed concrete have been introduced into the mixer drum 2. When it is determined in the step 3 that the materials for the freshly mixed concrete have been introduced, the routine advances to a step 4. When it is determined in the step 3 that the materials for the freshly mixed concrete have not been introduced, on the other hand, the routine returns.

In the step 4, the mixer drum 2 is switched to the high-speed mixing operation. As a result, the materials of the freshly mixed concrete introduced into the mixer drum 2 are mixed.

In a step 5, a determination is made as to whether or not a predetermined time has elapsed following the start of the mixing operation in the mixer drum 2. When it is determined in the step 5 that the predetermined time has elapsed, the routine advances to a step 6. The predetermined time is set at a time required to generate the freshly mixed concrete through the mixing operation in the mixer drum 2 following introduction of the materials into the mixer drum 2.

In the step 6, the mixer drum 2 is switched to the low-speed measurement rotation. The rotation speed of the mixer drum 2 during the measurement rotation may be identical to the rotation speed during the agitation rotation.

In a step 7, a determination is made as to whether or not the discharge pressure of the hydraulic pump 5 has fallen to the set pressure. When it is determined in the step 7 that the discharge pressure of the hydraulic pump 5 has not fallen to the set pressure, the routine advances to a step 10.

In the step 10, the water pressure pump 13 is activated and the open/close valve 14 is switched to the open state for a set time. As a result, a predetermined amount of the water stored in the water tank 12 is supplied to the mixer drum 2. At this time, the freshly mixed concrete in the mixer drum 2 has not yet been mixed to the appropriate slump, and therefore, by supplying the predetermined amount of water to the mixer drum 2, the freshly mixed concrete in the mixer drum 2 is brought closer to the appropriate slump.

After the predetermined amount of water has been supplied to the mixer drum 2 in the step 10, the routine advances to the step 4. Accordingly, the freshly mixed concrete in the mixer drum 2 is mixed further such that the slump of the freshly mixed concrete is adjusted.

When it is determined in the step 7 that the discharge pressure of the hydraulic pump 5 has fallen to the set pressure, on the other hand, this means that the freshly mixed concrete in the mixer drum 2 is at the appropriate slump, and therefore the routine advances to a step 8.

In the step 8, the notification device 35 is switched ON. By notifying the operator that the pressure of the working in the driving device 4 has fallen to or below the set pressure, the operator can be informed that the freshly mixed concrete in the mixer drum 2 has been adjusted to a predetermined slump.

Hence, in contrast to a conventional concrete mixer truck, in which the slump of the freshly mixed concrete is adjusted by the operator using a rule of thumb, the freshly mixed concrete carried on the concrete mixer truck 100 can be regulated to an appropriate slump automatically. As a result, variation in the slump of the freshly mixed concrete at the time of unloading can be suppressed, and the quality of the freshly mixed concrete can be managed.

In a step 9, the mixer drum 2 is switched to the agitation rotation. When the mixer drum 2 is switched to the agitation rotation in the step 9, slump adjustment of the freshly mixed concrete is complete, and therefore the routine advances to a step 11.

In the step 11, a determination is made as to whether or not the slump readjustment switch 32*e* has been operated. For example, the operator may readjust the slump of the freshly mixed concrete by operating the slump readjustment switch 32*e* before the freshly mixed concrete is discharged or the like. In so doing, the quality of the freshly mixed concrete can be checked immediately prior to unloading.

When it is determined in the step 11 that the slump readjustment switch 32*e* has been operated, the routine advances to the step 6, where the mixer drum 2 is switched to the measurement rotation, and then to the step 7, where the determination as to whether or not the discharge pressure of the hydraulic pump 5 has fallen to the set pressure is made again. When it is determined in the step 11 that the slump readjustment switch 32*e* has not been operated, on the other hand, the routine returns.

It should be noted that the operator may switch the mixer drum 2 to the high-speed mixing rotation for a predetermined time to remix the freshly mixed concrete by operating the mixing switch 32*f* before the freshly mixed concrete is discharged.

With the embodiment described above, the following effects are obtained.

The discharge pressure of the hydraulic pump 5 for driving the mixer drum 2 to rotate is detected by the pressure sensor 5*a*, and when the detected pressure falls to the set pressure, the operator is notified thereof by the notification device 35. The discharge pressure of the hydraulic pump 5 varies according to the carrying amount and the slump of the freshly mixed concrete in the mixer drum 2. The set pressure is set in advance in accordance with the carrying amount and the slump of the freshly mixed concrete.

By notifying the operator that the discharge pressure of the hydraulic pump 5 has fallen to the set pressure, the operator can be informed that the freshly mixed concrete in the mixer drum has been adjusted to a predetermined slump. As a result, variation in the slump of the freshly mixed concrete at the time of unloading can be suppressed, and the quality of the freshly mixed concrete can be managed.

Although the invention has been described above with reference to certain embodiments, the invention is not limited to the embodiments described above. Modifications and variations of the embodiments described above will occur to those skilled in the art, within the scope of the claims.

For example, in the above embodiment, the mixer drum 2 is switched to the mixing rotation after the materials are introduced into the mixer drum 2 and then switched to the measurement rotation after the predetermined time has elapsed following the switch to the mixing rotation. Further, the pressure determination unit 16 determines whether or not the discharge pressure of the hydraulic pump 5 has fallen to the set pressure.

However, this invention is not limited thereto, and instead, after the materials have been introduced into the mixer drum 2 and the mixer drum 2 has been switched to the mixing rotation, the pressure determination unit 16 may determine whether or not the discharge pressure of the hydraulic pump 5 has fallen to the set pressure continuously while the mixer drum 2 continues to perform the mixing rotation.

In this constitution, the mixer drum 2 is switched from the mixing rotation to the agitation rotation after the pressure determination unit 16 determines that the discharge pressure of the hydraulic pump 5 has fallen to the set pressure. Further, in this constitution, the predetermined amount of water is supplied to the mixer drum 2 in the step 10 when the pressure determination unit 16 determines that the discharge pressure of the hydraulic pump 5 has not fallen to the set pressure following the elapse of a predetermined time after the mixer drum 2 is switched to the mixing rotation.

The contents of 2011204860, with a filing date of Jul. 19, 2011 in Australia, are hereby incorporated by reference.

The embodiments of this invention in which an exclusive property or privilege is claimed are defined as follows:

1. A concrete mixer truck, comprising:

a mixer drum configured to carry freshly mixed concrete;

a driving device configured to be driven by rotation of an engine of the truck so as to drive the mixer drum to rotate using a fluid pressure of a working fluid;

a pressure detector configured to detect a pressure of the working fluid in the driving device;

a microprocessor configured to determine whether or not a material for generating the freshly mixed concrete has been introduced into the mixer drum, and determine whether or not the pressure of the working fluid detected by the pressure detector has fallen to a set pressure after the introduction of the material for the freshly mixed concrete into the mixer drum, wherein the set pressure is set in advance in accordance with a carrying amount and a fluidity of the freshly mixed concrete; and a notification device that is disposed in an operating cab of the truck and configured to notify an operator that the pressure of the working fluid in the driving device has fallen to the set pressure on the basis of a determination made by the microprocessor about the pressure of the working fluid.

2. The concrete mixer truck as defined in claim 1, wherein the set pressure is set in advance in accordance with the carrying amount of the freshly mixed concrete in the mixer drum as a working fluid pressure at which a slump, which is a numerical value indicating the fluidity of the freshly mixed concrete in the mixer drum, reaches an appropriate numerical value.

3. The concrete mixer truck as defined in claim 1, wherein, in a steady state, the driving device is configured to drive the mixer drum to perform agitation rotation at a rotation speed at which a quality of the freshly mixed concrete in the mixer drum is maintained, the microprocessor is configured to determine whether or not the material has been introduced into the mixer drum on the basis of the pressure of the working fluid detected by the pressure detector, and when the microprocessor determines that the material has been introduced into the mixer drum, the microprocessor is configured to switch the mixer drum to mixing rotation at a higher rotation speed than the agitation rotation.

4. The concrete mixer truck as defined in claim 3, wherein, when the microprocessor determines that the pressure of the working fluid in the driving device has fallen to the set pressure, the microprocessor is configured to switch rotation of the mixer drum to the agitation rotation.

5. The concrete mixer truck as defined in claim 3, wherein, when the microprocessor determines whether or not the pressure of the working fluid in the driving device has fallen to the set pressure, the microprocessor is configured to switch the rotation of the mixer drum to measurement rotation at a rotation speed for suppressing variation in the pressure of the working fluid accompanying the rotation of the mixer drum.

6. The concrete mixer truck as defined in claim 3, further comprising:

a water tank storing water; and an open/close valve provided in a supply passage and configured to supply water to the mixer drum from the water tank, wherein the microprocessor is configured to determine whether or not the pressure of the working fluid in the driving device has fallen to the set pressure after a set time elapses following the introduction of the material into the mixer drum, and when the microprocessor determines that the pressure of the working fluid in the driving device has not fallen to the set pressure, the microprocessor is configured to switch the open/close valve to an open state for a set time.

7. The concrete mixer truck as defined in claim 1, wherein the driving device comprises:

a fluid pressure pump configured to be driven by the rotation of the engine to discharge the working fluid, and a fluid pressure motor configured to be driven by the working fluid discharged from the fluid pressure pump to drive the mixer drum to rotate, and the pressure detector is configured to detect a discharge pressure of the fluid pressure pump.

8. The concrete mixer truck as defined in claim 1, further comprising:

a slump readjustment switch;

a water tank storing water; and a valve provided in a supply passage and configured to supply water to the mixer drum from the water tank, wherein in a steady state, the driving device is configured to drive the mixer drum to perform agitation rotation at a rotation speed at which a quality of the freshly mixed concrete in the mixer drum is maintained, and the microprocessor is configured to perform steps of (a) determining, on the basis of the pressure of the working fluid detected by the pressure detector, whether or not the material has been introduced into the mixer drum, (b) when the microprocessor determines at step (a) that the material has been introduced into the mixer drum, switching the mixer drum to mixing rotation at a higher rotation speed than the agitation rotation, (c) when a predetermined amount of time has elapsed since said switching the mixer drum to the mixing rotation, switching the mixer drum to measurement rotation at a rotation speed for suppressing variation in the pressure of the working fluid accompanying the rotation of the mixer drum, (d) after said switching the mixer drum to the measurement rotation, determining whether the pressure of the working fluid in the driving device has fallen to the set pressure, and (e) when the microprocessor determines at step (d) that the pressure of the working fluid in the driving device has fallen to the set pressure, switching the mixer drum to the agitation rotation, and causing the notification device to notify the operator that the pressure of the working fluid in the driving device has fallen to the set pressure.

9. The concrete mixer truck as defined in claim 8, wherein the microprocessor is further configured to perform a step of (f) when the microprocessor determines at step (d) that the pressure of the working fluid in the driving device has not fallen to the set pressure, opening the valve to an open state to supply a predetermined amount of water from the water tank to the mixer drum, switching the mixer drum to the mixing rotation, and proceeding to step (c).

10. The concrete mixer truck as defined in claim 9, wherein the microprocessor is further configured to perform a step of (g) after step (e) and in response to a detection that the lump readjustment switch has been operated, switching the mixer drum to the measurement rotation, and proceeding to step (d).

* * * * *